US008025335B2

(12) United States Patent
Gehner

(10) Patent No.: US 8,025,335 B2
(45) Date of Patent: Sep. 27, 2011

(54) CHAIR

(75) Inventor: Carsten Gehner, Hannover (DE)

(73) Assignee: Wilkhahn Wilkening + Hahne GmbH + Co. KG, Bad Münder (DE)

( * ) Notice: Subject to any disclaimer, the term of this patent is extended or adjusted under 35 U.S.C. 154(b) by 0 days.

(21) Appl. No.: 12/698,238

(22) Filed: Feb. 2, 2010

(65) Prior Publication Data

US 2010/0133884 A1 Jun. 3, 2010

Related U.S. Application Data

(62) Division of application No. 11/750,610, filed on May 18, 2007, now abandoned.

(30) Foreign Application Priority Data

May 22, 2006 (DE) ..... 10 2006 023 982

(51) Int. Cl.
*A47C 1/32* (2006.01)
*A47C 1/24* (2006.01)

(52) U.S. Cl. ..... 297/300.2; 297/302.1; 297/303.1; 297/284.11

(58) Field of Classification Search ..... 297/300.2, 297/302.1–302.2, 303.1, 284.11
See application file for complete search history.

(56) References Cited

U.S. PATENT DOCUMENTS

| | | | | |
|---|---|---|---|---|
| 4,744,600 | A * | 5/1988 | Inoue | 297/300.5 |
| 5,121,934 | A * | 6/1992 | Decker et al. | 297/300.8 |
| 5,209,549 | A * | 5/1993 | Chang | 297/320 |
| 5,577,802 | A * | 11/1996 | Cowan et al. | 297/301.2 |
| 6,601,918 | B2 * | 8/2003 | Mattsson | 297/284.11 |
| 6,607,244 | B2 * | 8/2003 | Stulik et al. | 297/302.4 |
| 7,036,882 | B2 * | 5/2006 | Elzenbeck | 297/300.1 |

* cited by examiner

*Primary Examiner* — David Dunn
*Assistant Examiner* — Tania Abraham
(74) *Attorney, Agent, or Firm* — Stites & Harbison PLLC; Douglas E. Jackson

(57) ABSTRACT

The invention relates to a chair with a seat, a base support and a backrest, wherein the seat is pivotably mounted on the base support and the backrest is pivotably mounted on the seat, and a first spring system is provided between the base support and the seat and a second spring system is provided between the seat and the backrest. Furthermore, means are provided for adjusting the spring behavior of the two spring systems so that the pivotability of the seat in relation to the base support and the pivotability of the backrest in relation to the seat can be adapted to different requirements, especially to users of different weights.

20 Claims, 8 Drawing Sheets

CHAIR

CROSS REFERENCE TO RELATED APPLICATIONS

This application is a divisional of application Ser. No. 11/750,610, filed May 18, 2007 now abandoned (which is hereby incorporated by reference).

FIELD OF THE INVENTION

The invention relates to a chair with a seat, a base support and a backrest.

BACKGROUND OF THE INVENTION

Many different chair designs are known in practice. In the so-called three-point mechanism, the seat, the base support and the backrest are coupled together via three articulation points in such a way that a predetermined synchronous relationship is established between the inclination of the seat and the inclination of the backrest. With respect to the location of the pivot point, three-point mechanisms of this type represent a compromise between different ergonomic requirements, which cannot be satisfied independently of one another.

DE-B-103 18 759 describes a two-point mechanism in which the seat is pivotably mounted on the base support with the interposition of a spring system. Furthermore, means are provided for adapting the spring behavior of this spring member to different requirements. The backrest is connected to the seat via an articulation axis, wherein synchronization between the inclination of the seat and the inclination of the backrest is rendered possible by means of a cable construction provided between the base support, the seat and the backrest.

A chair which has a two-point mechanism is known from DE-A-43 31 987, wherein the seat is pivotably mounted on the base support and the backrest is pivotably mounted on the seat, and a first spring system is provided between the base support and the seat and a second spring system is provided between the seat and the backrest. The special feature of this chair consists in that the pivoting axis of the seat is provided in the region of the user's ankles, and the pivoting axis of the backrest extends at least approximately through his hip joints. In this arrangement, the pivoting movement of the backrest in relation to the seat is not mechanically coupled to the pivoting movement of the seat in relation to the base support.

The object of the invention is to develop the chair further so that it can be adapted in a simple manner to different requirements, especially to users of different weights.

BRIEF SUMMARY OF THE INVENTION

The chair according to the invention substantially has a seat, a base support and a backrest, wherein the seat is pivotably mounted on the base support and the backrest is pivotably mounted on the seat, and a first spring system is provided between the base support and the seat and a second spring system is provided between the seat and the backrest, wherein the pivoting movement of the backrest in relation to the seat is not mechanically coupled to the pivoting movement of the seat in relation to the base support.

Furthermore, means are provided for adjusting the spring behavior of the two spring systems so that the pivotability of the seat in relation to the base support and the pivotability of the backrest in relation to the seat can be adapted to different requirements, especially to users of different weights.

Further developments of the invention form the subject-matter of the sub-claims.

As the pivoting movement of the backrest in relation to the seat is not mechanically coupled to the pivoting movement of the seat in relation to the base support, the two pivoting regions of the chair can be individually adapted to greatly differing requirements. Owing to the elimination of the mechanical coupling between the two articulations, less installation space is required for the chair mechanism and new chair design possibilities are opened up.

According to a preferred embodiment, the first spring system has at least one first spring member and the second spring system has at least one second spring member. Furthermore, the first spring member can co-operate with a first spring mechanism and the second spring member can co-operate with a second spring mechanism.

The means for adjusting the spring behavior of the two spring systems can be formed by means for adjusting the spring properties of the first and/or second spring member and/or by means for adjusting the first and/or second spring mechanism.

According to an especially advantageous development, the means for adjusting the spring behavior of the first spring system and the means for adjusting the spring behavior of the second spring system are coupled together in such a way that the adjustment of the spring behavior of the one spring system automatically effects adjustment of the spring behavior of the other spring system. In this case, the two spring systems and the means for adjusting the spring behavior of the two spring systems can be adapted to one another so that, even for users of different weights, substantially the same synchronous relationship between the inclination of the seat and the inclination of the backrest is rendered possible.

The means for adjusting the spring behavior of the two spring systems can be formed e.g. by means for adjusting the spring rate and/or the prestress of the first and/or second spring system, wherein the spring member and/or the spring mechanism of the respective spring system are optionally adjustable.

In a further development of the invention, the first spring system has a first spring member and a first spring mechanism co-operating with the spring member, and the means for adjusting the spring behavior of the spring system are formed by means for adjusting different spring characteristics of the spring system, wherein the spring system is formed so that the spring member is unloaded in the normal position of the chair, also for users of different weights, and in this unloaded starting position of the spring member all the adjustable spring characteristics of the spring system have a common origin.

In a further development of the invention, the seat is pivotable about a first articulation axis and the backrest is pivotable about a second articulation axis, wherein the two articulation axes are arranged so as to be displaceable relative to one another. In this way, the depth of the seat can be adjusted, whereby the seat depth can, in particular, be adapted to the distance between the knee joint and the hip joint in users of different heights.

BRIEF DESCRIPTION OF THE DRAWINGS

Further developments and advantages of the invention will be further explained herein below with the aid of the description and the drawings, wherein.

DETAILED DESCRIPTION OF THE INVENTION

Figure 2:
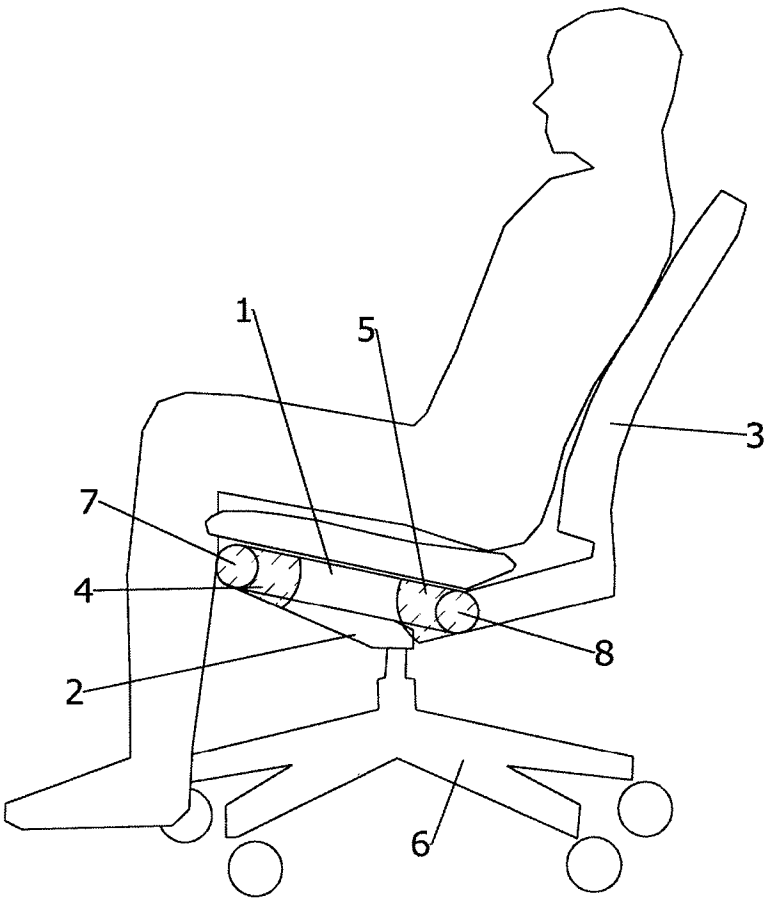
FIG. 2 shows a side view of the chair in a tilted-back position.
Figure 1:
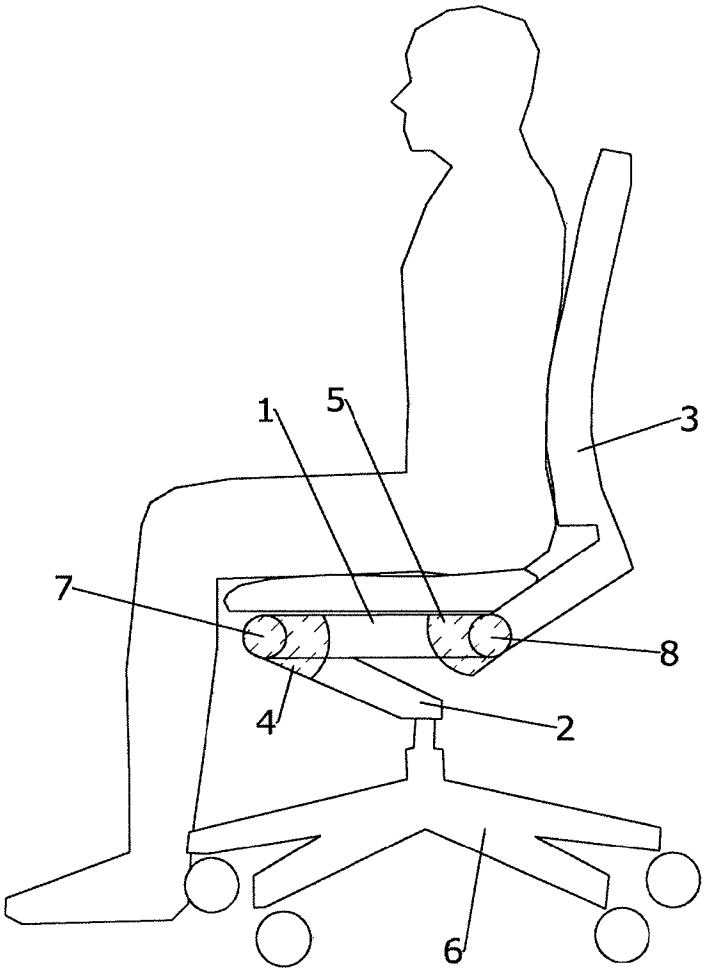
FIG. 1 shows a schematic side view of a chair in an upright normal position.

The chair shown in FIGS. 1 and 2 substantially comprises a seat 1, a base support 2 and a backrest 3, wherein the seat is pivotably mounted on the base support and the backrest is pivotably mounted on the seat. A first spring system 4 is provided between the base support 2 and the seat 1 and a second spring system 5 is provided between the seat 1 and the backrest 3.

The base support 2 is conventionally mounted on a foot or swivel frame 6. The seat and the backrest can in particular also comprise a seat support and a backrest support respectively.

In order to permit the pivoting movement of the seat or backrest, a first articulation axis 7 is provided between the base support and the seat and a second articulation axis 8 is provided between the seat and the backrest. In this arrangement, the pivoting movement of the backrest 3 in relation to the seat 1 is not mechanically coupled to the pivoting movement of the seat 1 in relation to the base support 2. Therefore, this is a two-point mechanism.

Figure 3:
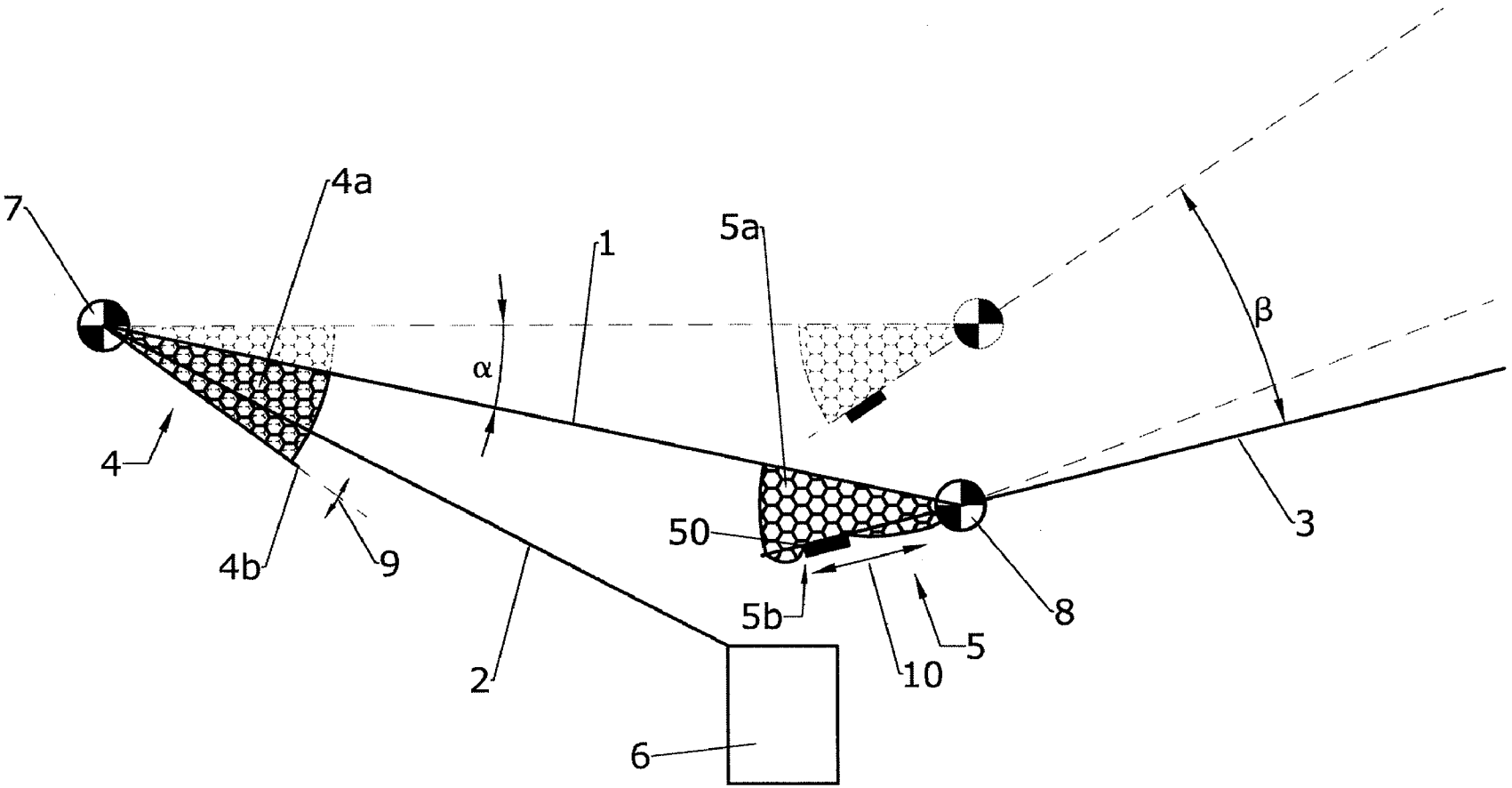
FIG. 3 shows a schematic representation of the two spring systems according to a first embodiment.

As can be seen from FIG. 3 in particular, the first spring system 4 comprises a first spring member 4*a* and a first spring mechanism 4*b* co-operating with the spring member.

In the embodiment shown, the spring member 4*a* is formed by a suitable foamed material wedge, for example made of Celasto, while the first spring mechanism 4*b* co-operating with the first spring member is formed by a counter or thrust bearing which is pivotable about the first articulation axis 7. Furthermore, first means 9 are provided for adjusting the spring behavior of the first spring system 4 and are represented purely schematically by a double arrow. The first spring mechanism 4*b* (counter or thrust bearing) is rotatable about the first articulation axis 7 by these first means 9 for adjusting the spring behavior and thereby prestresses the first spring member 4*a* to a greater or lesser extent.

The second spring system 5 in the region of the second articulation axis 8 comprises a second spring member 5*a* and a second spring mechanism 5*b* co-operating therewith. In this case too, the second spring member 5*a* is formed by a foamed material wedge, for example made of Celasto. The second spring mechanism 5*b* is formed here by a compression body 50 which is adjustable by means 10 for adjusting the spring behavior of the second spring system 5. For their part, the means 10 are represented purely schematically by a double arrow.

While the adjustment of the spring behavior of the first spring system, especially during compression of the first spring member 4*a*, requires some expenditure of force, the compression body forming the second spring mechanism can be displaced in a substantially force-free manner in the unloaded, upright normal position of the backrest.

Figure 4A:
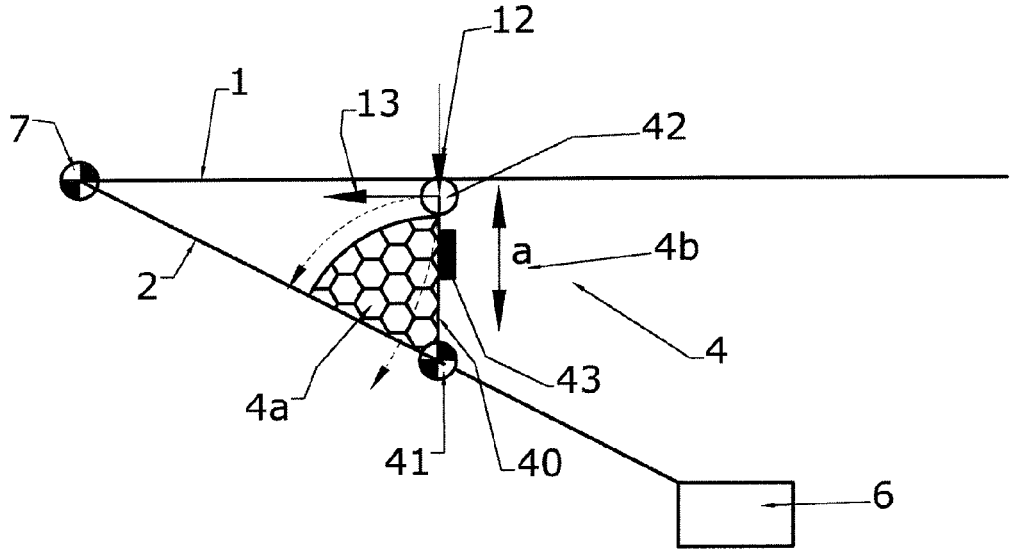
FIG. 4*a* shows a schematic representation of an alternative spring system in the normal position.

It goes without saying that the same or also different spring systems, for example compression springs, can be used for the two articulations within the scope of the invention. An alternative spring system will be described herein below with reference to FIGS. 4*a* and 4*b*, which spring system could also be applied to other chair mechanisms, especially a three-point mechanism. The chair shown in FIGS. 4*a* and 4*b* has at least two parts which are movable relative to one another, especially a seat 1 and a base support 2 which are movable relative to one another between a normal position (FIG. 4*a*) and a tilted position (4*b*), wherein a spring system 4 is provided between the two parts and has a spring member 4*a* and a spring mechanism 4*b* co-operating with the spring member, and furthermore wherein means are provided for adjusting different spring characteristics of the spring system so that the movability of the two parts can be adapted to different requirements, especially to users of different weights. The spring member is formed e.g. by a suitable foamed material wedge, for example made of Celasto, while the spring mechanism can have a pendulum rod 40, one end of which is mounted on the base support 2 about an articulation axis 41 and the other end of which is in contact with the seat 1 via a rolling body 42. In this embodiment, the means for adjusting different spring characteristics of the spring system are formed by a compression body 43 which is adjustable in the direction of the double arrow 9.

Figure 7:
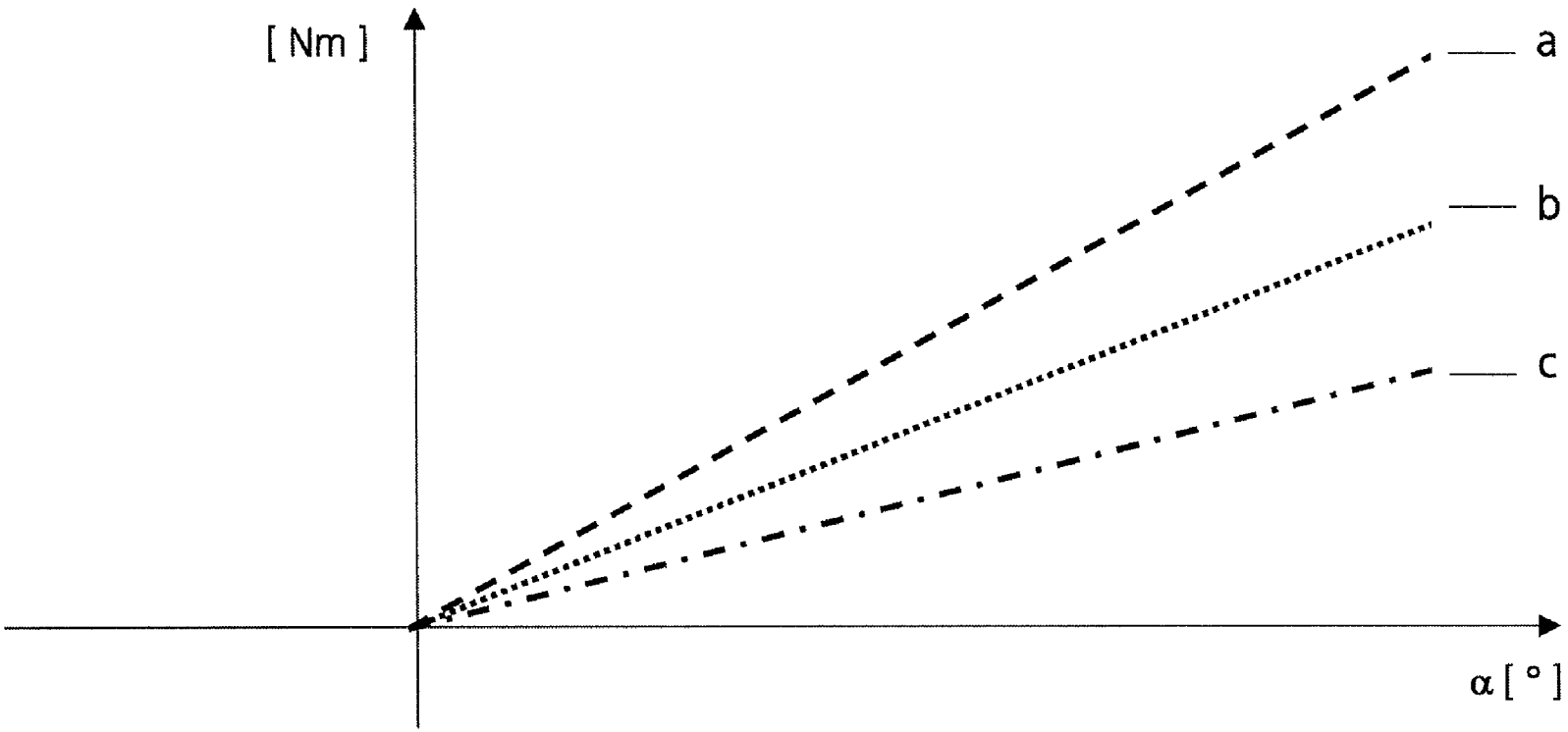
FIG. 7 shows a representation of the spring characteristic of the first and/or second spring system according to a second variant.

The spring system 4 is formed so that the spring member 4*a* is unloaded in the normal position of the chair, also for users of different weights, and in this unloaded starting position of the spring member all the adjustable spring characteristics of the spring system have a common origin. By displacement of the compression body 43, in particular the spring characteristics a, b and c shown in FIG. 7 can be adjusted in this way.

According to a preferred development of the chair, in the normal position thereof, the direction (arrow 12) in which the spring mechanism is loaded by the user lies at right angles to the direction (arrow 13) in which the spring mechanism acts on the spring member. In this normal position, displacement of the compression body 43 is possible without great expenditure of force, although the seat can be loaded by a user.

Figure 4B:
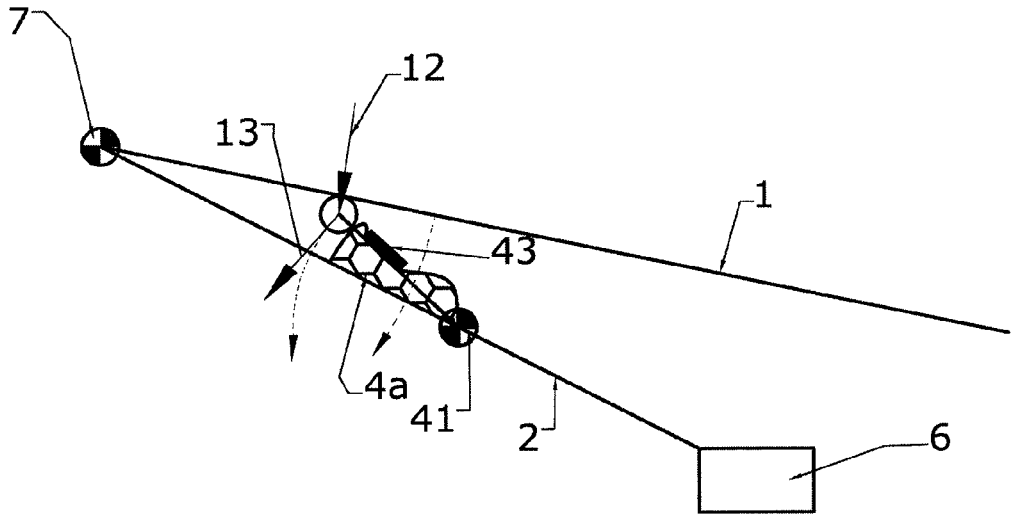
FIG. 4*b* shows a schematic representation of the alternative spring system according to FIG. 4*a* in the tilted position.

When the user leans back, the pendulum rod is deflected about the articulation point 41 as the rolling body 42 moves along the underside of the seat 1 in the direction of the first articulation axis 7, whereby the spring member 4*a* is compressed in accordance with the load (see FIG. 4*b*).

Figure 5A:
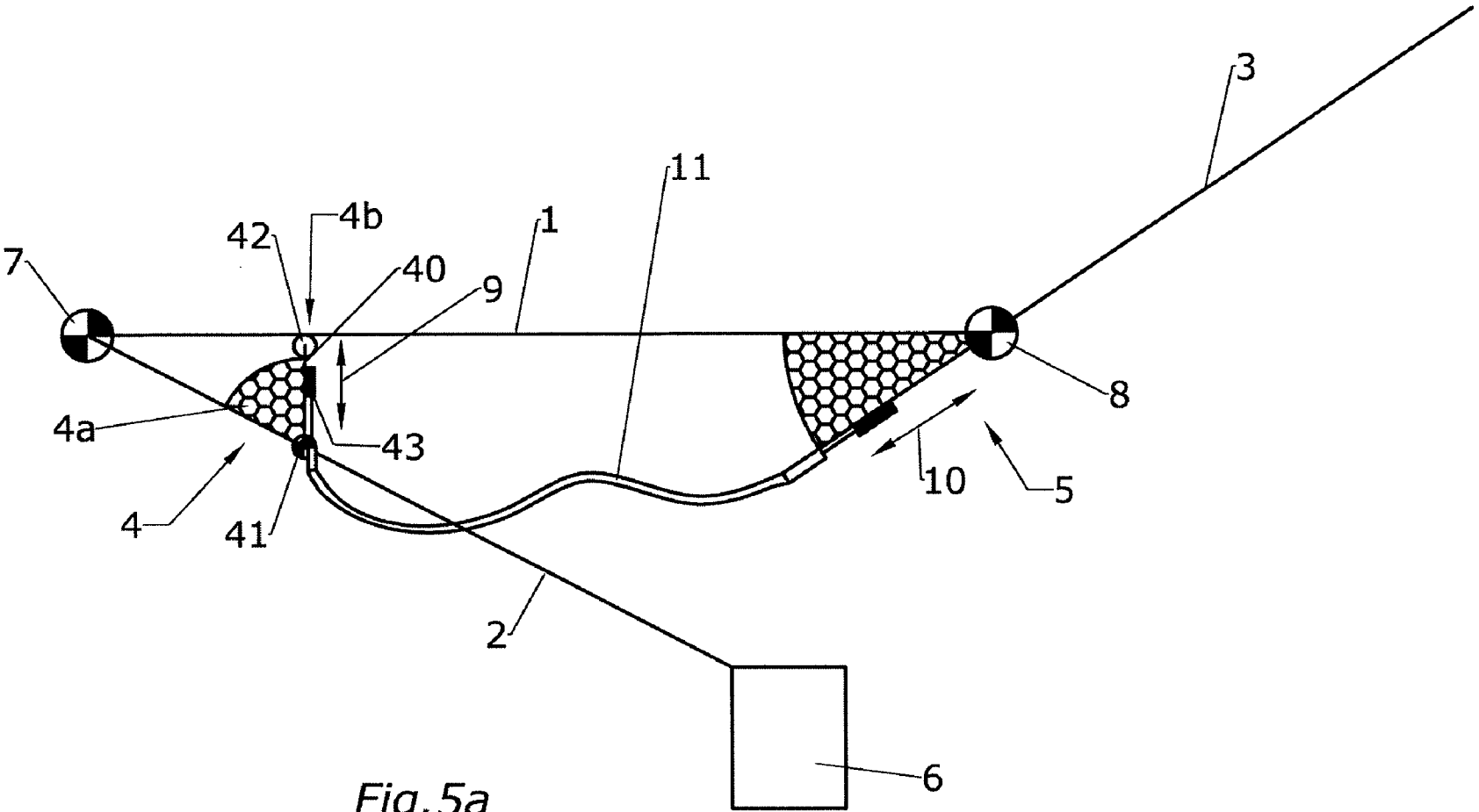
FIG. 5*a* shows a schematic representation of the two spring systems according to a second embodiment (in the upright normal position)
Figure 5B:
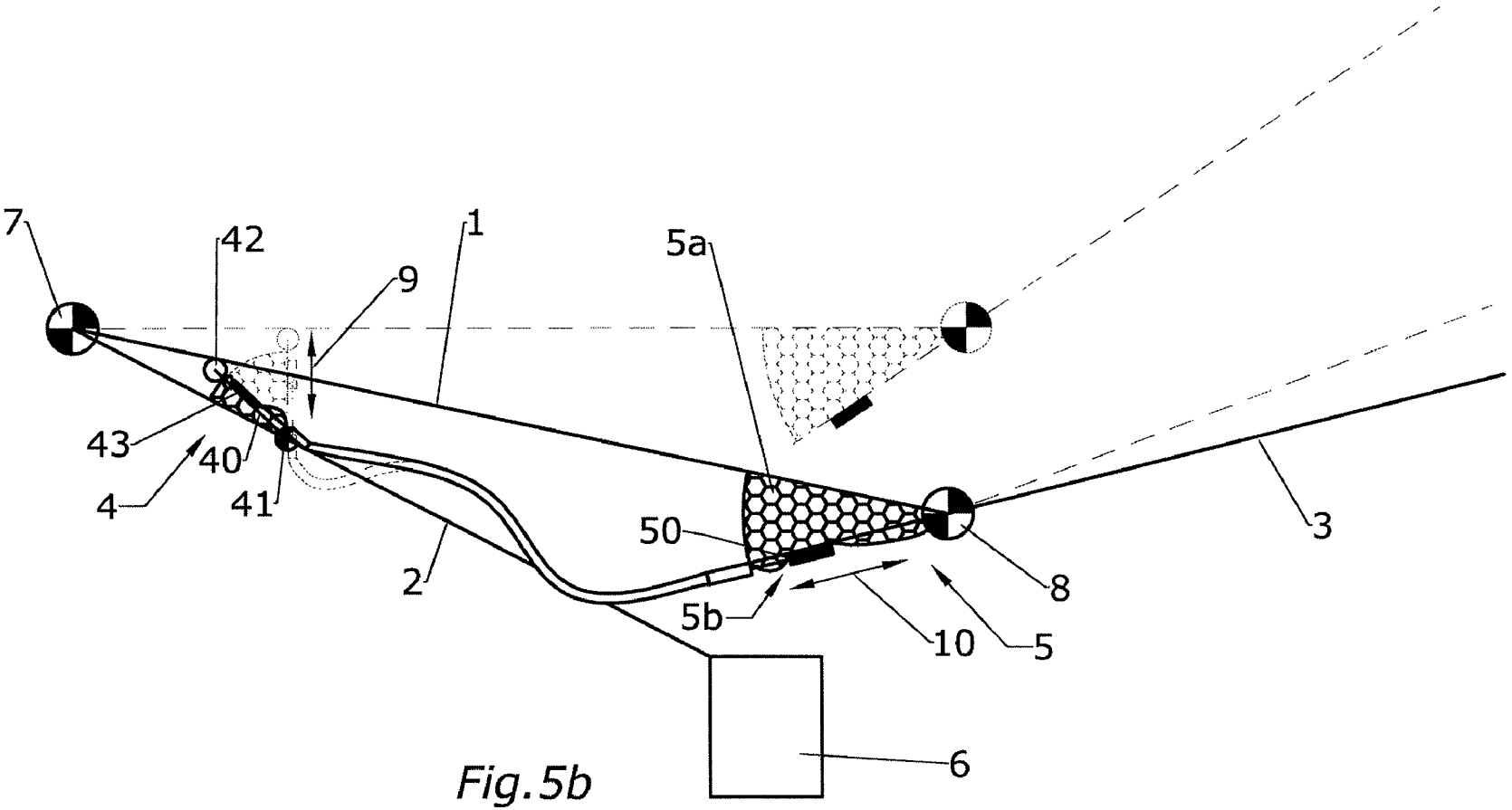
FIG. 5*b* shows a schematic representation of the two spring systems according to FIG. 4 in the tilted-back position.

In FIGS. 5*a* and 5*b*, a further embodiment is shown in the upright normal position (FIG. 5*a*) and the tilted-back position (FIG. 5*b*). In this case, the first spring system 4 is formed in accordance with the spring system shown in FIGS. 4*a* and 4*b*, while the second spring system 5 corresponds to the second spring system in FIG. 3.

For its part, the first spring system 4 has a first spring member 4*a* which co-operates with a first spring mechanism 4*b* having a pendulum rod 40, one end of which is mounted on the base support 2 about an articulation axis 41 and the other end of which is in contact with the seat 1 via a rolling body 42. In the upright normal position of the chair as shown in FIG. 4, the pendulum rod 40 is disposed almost perpendicularly to the seat 1. When the user leans back, the pendulum rod is deflected about the articulation point 41 as the rolling body 42 moves along the underside of the seat 1 in the direction of the first articulation axis 7, whereby the first spring member 4*a* is compressed in accordance with the load. In order to change the spring behavior of the first spring system, the first spring mechanism 4*b* is also provided with a compression body 43, which is adjustable by schematically shown means 9.

Furthermore, additional coupling means 11 can be provided which couple together the means 9 for adjusting the spring behavior of the first spring system 4 and the means 10 for adjusting the spring behavior of the second spring system 5 in such a way that the adjustment of the spring behavior of the one spring system automatically effects adjustment of the spring behavior of the other spring system. These coupling means can be formed e.g. by a Bowden cable and effect simultaneous displacement of the compression bodies 43 and 50.

By suitable co-ordination of the two spring systems 4, 5, the spring behavior of the two spring systems can be adapted to the desired requirement in a single operation. In this way, it is ensured in particular that, even for users of different weights, substantially the same synchronous relationship between the inclination of the seat and the inclination of the backrest is rendered possible.

In FIG. 3, the angle at which the seat is inclined relative to the base support is designated by $\alpha$ and the angle at which the backrest 3 is inclined relative to the starting position is designated by $\beta$. In this case, a suitable synchronous relationship of $\alpha/\beta$ in the range from 1:1.5 to 1:3.5 is produced.

Figure 6:
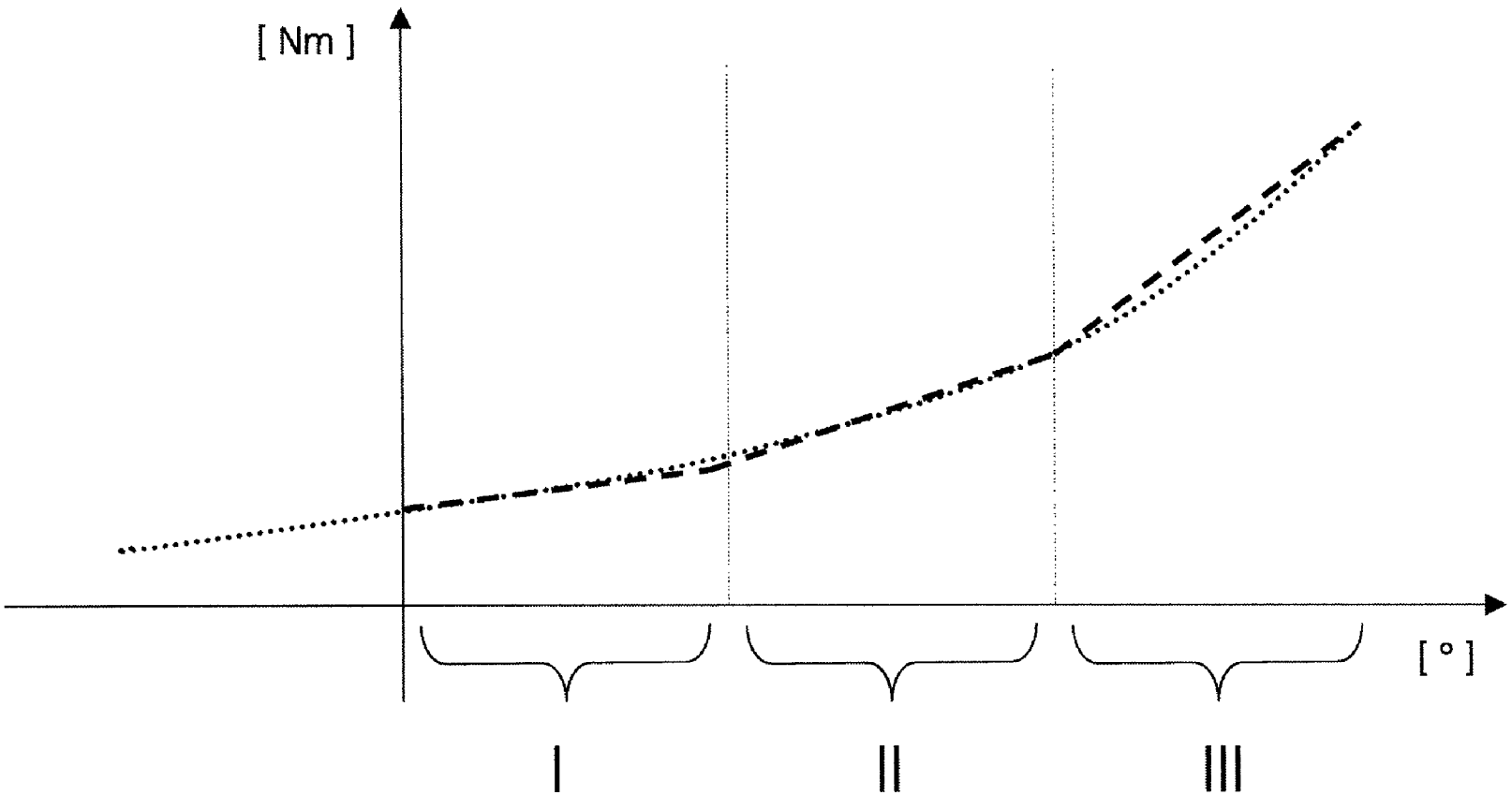
FIG. 6 shows a representation of the spring characteristic of the first spring system according to a first variant.

FIG. 6 shows the spring characteristic of a progressive spring member such as could be used e.g. for the first spring system. Different spring rates should advantageously be provided for the adjustment angle $\alpha$ for users of different weights. The spring member is formed e.g. by the foamed material wedge shown in FIG. 3, which can be prestressed from 0 to 30° by the spring mechanism 4*b*.

The spring characteristic shown in FIG. 6 can be divided e.g. into three portions of equal size in which an approximately linear spring characteristic is established, namely portion I for light persons, portion II for persons of average weight and portion III for heavy persons. Owing to the progressive spring characteristic, variously high average spring rates are produced in the individual portions. In order to pass from one portion to the next and thereby change the average spring rate of the spring member, the foamed material wedge is further prestressed by 15° each time. It goes without saying that any intermediate positions can also be set.

However, depending upon the spring system, some prestress may already have to be exerted on the spring member for the lightest setting. It would therefore be desirable if adjustment of the spring rate is rendered possible without the need for special expenditure of force by prestressing the spring member. This is made possible by the particular configuration of the two spring systems 4 and 5 according to FIGS. 4*a*, 4*b*, 5*a* and 5*b*. By displacement of the compression body 43 or 50, the spring rate of the spring member 4*a* or 5*a* can be adjusted in a manner relatively free of force in that only the frictional force has to be overcome for displacement of the compression body. According to the position of the compression body in conjunction with the particular spring mechanism, the spring characteristics shown in FIG. 7 can be set, wherein characteristic a is intended for a heavy user, characteristic b for a user of average weight and characteristic c for a light user. In this case, the angle of inclination $\alpha$ of the seat is plotted towards the right and the torque is plotted upwards.

Figure 9:
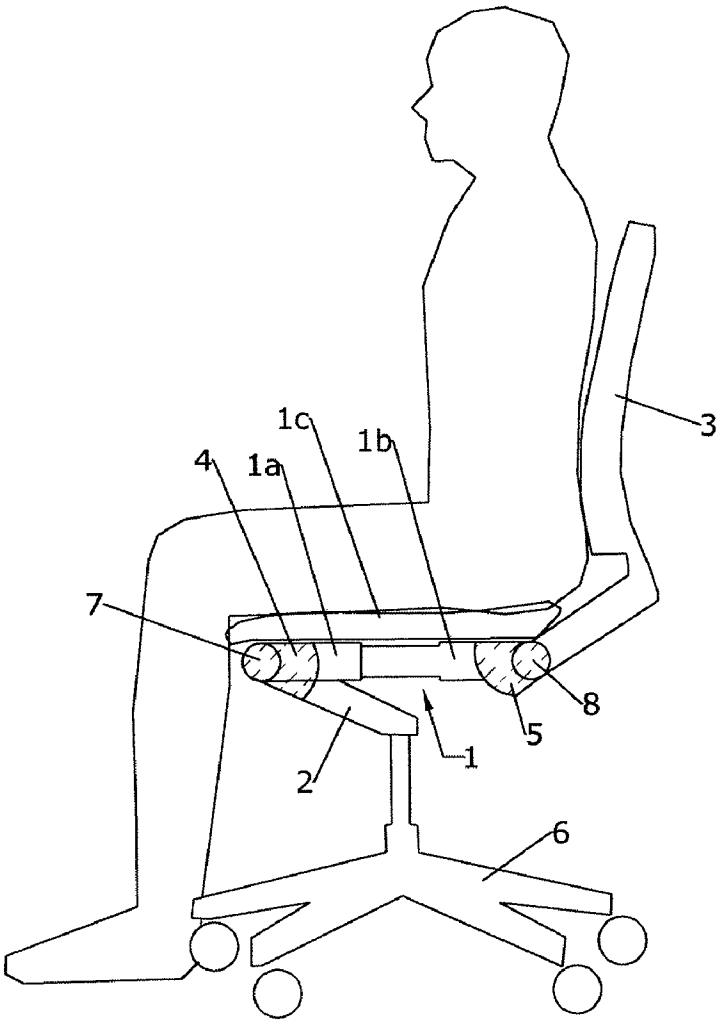
FIG. 9 shows a side view of the chair with seat-depth adjustment in a second position.
Figure 8:
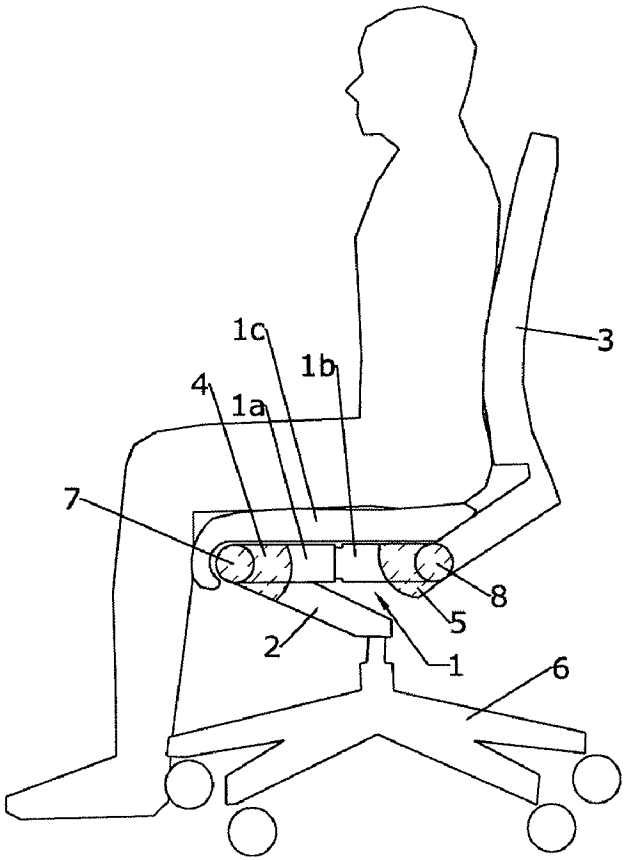
FIG. 8 shows a side view of a chair with seat-depth adjustment in a first position.

The independence of the pivoting movements of the seat and the backrest provides the possibility of arranging the two articulation axes 7, 8 so as to be displaceable relative to one another in order to permit adjustment of the seat depth, which will be further described with reference to FIGS. 8 and 9.

The seat 1 comprises a first seat supporting part 1*a*, a second seat supporting part 1*b* and a seat cushion 1*c*. The two seat supporting parts 1*a* and 1*b* are arranged so as to be displaceable relative to one another by a suitable mechanism, wherein the first seat supporting part 1*a* is connected to the base support 2 via the first articulation axis 7 and the second seat supporting part 1*b* is connected to the backrest 3 via the second articulation axis 8.

In this way, the seat depth can be specifically adapted to the respective user by displacing the two seat supporting parts relative to one another. As the distance between hip and knee joint can vary in length in different persons according to their build, optimum adjustment of the chair is permitted in this manner. Although it can be possible to fix the seat-depth setting, it is provided in a particular development of the invention that the seat depth is set automatically when the user sits down. In this case, it is possible for a spring member to be provided between the two seat supporting parts so that the seat adopts a contracted position in the unloaded state.

The adjustability of the two spring systems permits optimum adaptation of the chair to the respective requirements. In addition, the independence of the two articulations gives rise to new design possibilities because an additional connecting mechanism is not required. Furthermore, the two independent articulation points permit adjustment of the seat depth without having to forego the ergonomically favorable adjustment of the seat and backrest in a particular synchronous relationship.

In a further development (not shown in further detail) of the invention, means for blocking the first and/or second spring system can be provided in the above described chairs. There is then the possibility of fixing the rear or front articulation in order to obtain a simple rocker mechanism. In this case, the angle between the backrest and the seat or between the seat and the base support would remain constant when the user leans back. One would then have the possibility of switching between a simple rocker mechanism and synchronous tilting of the seat and backrest.

The above described embodiments each have a first and a second spring system. It is naturally also possible to include further joints of the body (ankle joint, neck vertebrae, etc.) by means of additional spring systems in accordance with the present principle.

The invention claimed is:

1. A chair comprising:

a seat, a base support and a backrest, wherein the seat is pivotably mounted on the base support and the backrest is pivotably mounted on the seat;

a first spring system provided between the base support and the seat, and a second spring system provided between the seat and the backrest;

wherein the pivoting movement of the backrest in relation to the seat is separate from the pivoting movement of the seat in relation to the base support;

first and second adjusting means for respectively adjusting a spring behavior of the first and second spring systems so that the pivotability of the seat in relation to the base support and the pivotability of the backrest in relation to the seat can be adapted to different requirements, said first adjusting means for adjusting the spring behavior of the first spring system and said second adjusting means for adjusting the spring behavior of the second spring system being coupled together in such a way that an adjustment of the spring behavior of one of the first and second spring systems automatically effects adjustment of the spring behavior of the other of the first and second spring systems; and wherein the seat is pivotable about a first articulation axis in the region of the front end of the seat and the backrest is pivotable about a second articulation axis in the region of the rear end of the seat, with the two articulation axes being arranged so as to be displaceable relative to one another.

2. A chair according to claim 1, wherein the first spring system has at least one first spring member, and the second spring system has at least one second spring member.

3. A chair according to claim 2, wherein the first and second adjusting means for adjusting the spring behavior of the two spring systems are formed by devices which adjust at least one of a) spring properties of the first and/or second spring members or b) first and/or second spring mechanisms of the respective first and second spring systems.

4. A chair according to claim 1, wherein the first spring system has at least one first spring member and a first spring mechanism co-operating with the first spring member, and the second spring system has at least one second spring member and a second spring mechanism co-operating with the second spring member.

5. A chair according to claim 4, wherein the first and second adjusting means for adjusting the spring behavior of the two spring systems are formed by respective devices which adjust at least one of a) spring rate or b) prestress of the first and/or second spring system.

6. A chair according to claim 5, wherein the spring member and/or the spring mechanism of the respective spring system are adjustable.

7. A chair according to claim 4, wherein, in a normal position of the chair, a direction in which the spring mechanism is loaded by the user lies at right angles to the direction in which the spring mechanism acts on the spring member.

8. A chair according to claim 1, wherein the first and second spring systems and the first and second adjusting means for adjusting the spring behavior of the two spring systems are adapted to one another so that, even for users of different weights, substantially the same synchronous relationship between the inclination of the seat and the inclination of the backrest is rendered possible.

9. A chair according to claim 1, wherein the first spring system has a first spring member and a first spring mechanism co-operating with the first spring member, and wherein the first and second adjusting means for adjusting the spring behavior of the first and second spring systems are formed by devices which adjust different spring characteristics of the respective first and second spring systems, wherein the first and second spring systems are formed so that the respective spring member is unloaded in the normal position of the chair, and also so that for users of different weights, and in this unloaded starting position of the spring member, all the adjustable spring characteristics of the spring system have a common origin.

10. A chair according to claim 1, wherein the pivotability of the seat relative to the base support, and the pivotability of the backrest in relation to the seat, are adaptable to users of different weights.

11. A chair comprising:

a seat, a base support and a backrest, wherein the seat is pivotably mounted on the base support and the backrest is pivotably mounted on the seat;

a first spring system provided between the base support and the seat, and a second spring system provided between the seat and the backrest;

wherein the pivoting movement of the backrest in relation to the seat is separate from the pivoting movement of the seat in relation to the base support;

first and second adjusting means for respectively adjusting a spring behavior of the first and second spring systems so that the pivotability of the seat in relation to the base support and the pivotability of the backrest in relation to the seat can be adapted to different requirements, said first adjusting means for adjusting the spring behavior of the first spring system and said second adjusting means for adjusting the spring behavior of the second spring system being coupled together in such a way that an adjustment of the spring behavior of one of the first and second spring systems automatically effects adjustment of the spring behavior of the other of the first and second spring systems; and wherein the seat is pivotable about a first articulation axis and the backrest is pivotable about a second articulation axis, with the two articulation axes being arranged so as to be displaceable relative to one another, and wherein the first and second spring systems and the first and second adjusting means for adjusting the spring behavior of the two spring systems are adapted to one another so that, even for users of different weights, substantially the same synchronous relationship between the inclination of the seat and the inclination of the backrest is rendered possible.

12. A chair according to claim 11, wherein the first spring system has at least one first spring member, and the second spring system has at least one second spring member.

13. A chair according to claim 12, wherein the first and second adjusting means for adjusting the spring behavior of the two spring systems are formed by devices which adjust at least one of a) spring properties of the first and/or second spring members or b) first and/or second spring mechanisms of the respective first and second spring systems.

14. A chair according to claim 11, wherein the first spring system has at least one first spring member and a first spring mechanism co-operating with the first spring member, and the second spring system has at least one second spring member and a second spring mechanism co-operating with the second spring member.

15. A chair according to claim 14, wherein the first and second adjusting means for adjusting the spring behavior of the two spring systems are formed by respective devices which adjust at least one of a) spring rate or b) prestress of the first and/or second spring system.

16. A chair according to claim 15, wherein the spring member and/or the spring mechanism of the respective spring system are adjustable.

17. A chair according to claim 14, wherein, in a normal position of the chair, a direction in which the spring mechanism is loaded by the user lies at right angles to the direction in which the spring mechanism acts on the spring member.

18. A chair comprising:

a seat, a base support and a backrest, wherein the seat is pivotably mounted on the base support and the backrest is pivotably mounted on the seat;

a first spring system provided between the base support and the seat, and a second spring system provided between the seat and the backrest;

wherein the pivoting movement of the backrest in relation to the seat is separate from the pivoting movement of the seat in relation to the base support;

first and second adjusting means for respectively adjusting a spring behavior of the first and second spring systems so that the pivotability of the seat in relation to the base support and the pivotability of the backrest in relation to the seat can be adapted to different requirements, said first adjusting means for adjusting the spring behavior of the first spring system and said second adjusting means for adjusting the spring behavior of the second spring system being coupled together in such a way that an adjustment of the spring behavior of one of the first and second spring systems automatically effects adjustment of the spring behavior of the other of the first and second spring systems; and wherein the seat is pivotable about a first articulation axis and the backrest is pivotable about a second articulation axis, with the two articulation axes being arranged so as to be displaceable relative to one another, wherein the first spring system has a first spring member and a first spring mechanism co-operating with the first spring member, and wherein the first and second adjusting means for adjusting the spring behavior of the first and second spring systems are formed by devices which adjust different spring characteristics of the respective first and second spring systems, wherein the first and second spring systems are formed so that the respective spring member is unloaded in the normal position of the chair, and also so that for users of different weights, and in this unloaded starting position of the spring member, all the adjustable spring characteristics of the spring system have a common origin.

19. A chair according to claim 18, wherein the first and second spring systems and the first and second adjusting means for adjusting the spring behavior of the two spring systems are adapted to one another so that, even for users of different weights, substantially the same synchronous relationship between the inclination of the seat and the inclination of the backrest is rendered possible.

20. A chair according to claim 19, wherein the seat is pivotable about a first articulation axis in the region of the front end of the seat, and the backrest is pivotable about a second articulation axis in the region of the rear end of the seat.

* * * * *